US012115433B2

(12) United States Patent
Qiao

(10) Patent No.: US 12,115,433 B2
(45) Date of Patent: Oct. 15, 2024

(54) FITNESS DISPLAY DEVICE AND A FITNESS WEIGHT DEVICE

(71) Applicant: NINGBO DAOKANG INTELLIGENT TECHNOLOGY CO., LTD., Zhejiang (CN)

(72) Inventor: Wei Qiao, Yuyao (CN)

(73) Assignee: NINGBO DAOKANG INTELLIGENT TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 17/922,346

(22) PCT Filed: May 27, 2020

(86) PCT No.: PCT/CN2020/092572
§ 371 (c)(1),
(2) Date: Oct. 28, 2022

(87) PCT Pub. No.: WO2021/217767
PCT Pub. Date: Nov. 4, 2021

(65) Prior Publication Data

US 2023/0173372 A1 Jun. 8, 2023

(30) Foreign Application Priority Data

Apr. 29, 2020 (CN) ..... 202020692557.7

(51) Int. Cl.
*A63B 71/06* (2006.01)
*A63B 21/062* (2006.01)
*A63B 24/00* (2006.01)

(52) U.S. Cl.
CPC ..... *A63B 71/0622* (2013.01); *A63B 21/0628* (2015.10); *A63B 24/0062* (2013.01);
(Continued)

(58) Field of Classification Search
CPC ..... A63B 71/0622; A63B 21/0628; A63B 24/0062; A63B 2071/0658;
(Continued)

(56) References Cited

U.S. PATENT DOCUMENTS 6,342,028 B1 * 1/2002 de Sane ..... A63B 21/0628 73/379.08
6,705,976 B1 * 3/2004 Piane, Jr. ..... A63B 21/4043 482/102

(Continued)

FOREIGN PATENT DOCUMENTS

CN 209286573 U 8/2019

*Primary Examiner* — Andrew S Lo
(74) *Attorney, Agent, or Firm* — Ying-Ting Chen

(57) ABSTRACT

The fitness display apparatus comprises an outer housing provided on guide rails (1) and capable of moving under the limit of the guide rails (1); a display screen (14) is provided on the outer housing, the outer housing is internally provided with a generator (11), a PCB (12), a tension sensor (9) and a rechargeable battery (10), the PCB (12) is provided with a charging circuit and a control chip; the generator (11) is connected to the rechargeable battery (10) by means of the charging circuit; a rotor of the generator (11) is in contact with the guide rails (1), and when the outer housing moves, the rotor of the generator (11) rotates; the rechargeable battery (10) is electrically connected to the PCB (12); the tension sensor (9) and the display screen (14) are respectively electrically connected to the PCB (12); and the tension sensor (9) is provided between an external device and a load bearing rod (3). By providing a display unit, exercise data can be intuitively displayed; obtained data can be sent to a mobile device or a cloud by means of a wireless module, and an exercise process is accurately described in combination with a suitable APP and other software, laying a foundation for datamation of training processes and training effects.

2 Claims, 11 Drawing Sheets

(52) U.S. Cl.
CPC ... *A63B 2071/0658* (2013.01); *A63B 2220/50* (2013.01); *A63B 2225/50* (2013.01)

(58) Field of Classification Search
CPC ..... A63B 2220/50; A63B 2225/50; A63B 21/0054; A63B 2220/20; A63B 2220/17; A63B 2220/30; A63B 2220/51; A63B 2220/52
See application file for complete search history.

(56) References Cited

U.S. PATENT DOCUMENTS 8,062,182 B2 * 11/2011 Somers ..... A63B 21/0628 482/8
10,905,916 B1 * 2/2021 Malik ..... A61B 5/1128
2003/0032529 A1 * 2/2003 Alessandri ..... A63B 24/00 482/8
2005/0272561 A1 * 12/2005 Cammerata ..... A63B 23/0494 482/8
2011/0287896 A1 * 11/2011 Kim ..... A63B 21/065 482/8
2012/0100961 A1 * 4/2012 Nishimura ..... A63B 21/062 482/5
2013/0244841 A1 * 9/2013 Anderson ..... A63B 21/062 482/98
2014/0121071 A1 * 5/2014 Strom ..... A63B 21/156 482/99
2014/0171273 A1 * 6/2014 Rapp ..... A63B 21/0628 482/102
2015/0209609 A1 * 7/2015 Oteman ..... A63B 24/0087 482/8
2016/0101311 A1 * 4/2016 Workman ..... A63B 21/063 482/98
2016/0325141 A1 * 11/2016 Wu ..... G06Q 10/0639
2018/0099184 A1 * 4/2018 Eder ..... A63B 21/154
2018/0345080 A1 * 12/2018 Orfield ..... A61B 5/224
2019/0126090 A1 * 5/2019 O'Connor ..... A63B 21/155
2019/0321709 A1 * 10/2019 Downey ..... A63B 21/063
2020/0070001 A1 * 3/2020 Malis ..... A63B 24/0062
2020/0316434 A1 * 10/2020 Bengtsson ..... A61B 5/6895
2021/0402256 A1 * 12/2021 Huch ..... A63B 24/0062

* cited by examiner

FITNESS DISPLAY DEVICE AND A FITNESS WEIGHT DEVICE

CROSS REFERENCE OF RELATED APPLICATION

This application claims the benefit under 35 U.S.C. § 119 from International Application No. PCT/CN2020/092572, which claims priorities to CN202020692557.7, filed Apr. 19, 2020, the entire contents of which are hereby incorporated by reference in their entireties for teachings of additional or alternative details, and/or features.

BACKGROUND OF THE PRESENT INVENTION

Field of Invention

The present utility model relates to the field of fitness equipment, in particular to a fitness display device and a fitness weight device.

Description of Related Arts

Fitness can be roughly classified into instrument exercise and non-instrument exercise. Fitness is also an exercise method used by many men and women to build a perfect figure. Modern men and women like this sport. With the improvement of living standards, people pay more and more attention to fitness, and they usually use fitness equipment, such as dumbbells, treadmills, weight devices, etc, to achieve the desired fitness effect.

However, the existing weight device cannot automatically detect and display the weight selected by the user each time, automatically detect the distance and speed of the weights being lifted and lowered, and transmit the acquired data to other devices in a wireless way, such as control panel, mobile phone, tablet computer, TV and other devices, or to the Cloud for being used by other applications.

The utility model patent Pat. No. CN209286573U discloses a knob-type adjustable weight device and a knob type adjustable weight fitness equipment, wherein the weight device directly adjusts the configured weight by rotating the knob, which is applied to fitness equipment with high safety and can effectively avoid body pinch injuries during operation, wherein the weight device comprises a weight assembly, a traction mechanism and a rotary adjustment mechanism, wherein the weight assembly comprises a plurality of fixed weight plates and a plurality of adjustable weight plates, which are stacked with each other, and the fixed weight plates are located above the adjustable weight plates, wherein each of the fixed weight plates and the adjustable weight plates has a through hole provided in the center thereof, and the uppermost fixed weight plate is connected with the traction mechanism, such that the traction mechanism can drive the uppermost fixed weight plate to move longitudinally, wherein the rotary adjustment mechanism includes a transmitting shaft and a selecting rod, wherein the selecting rod is a hollow sleeve structure, and the transmitting shaft is inserted into the selecting rod from top to bottom, when the transmitting shaft rotates around the central axis, the selecting rod can be driven to rotate synchronously. However, the above scheme cannot realize the detection and display of weight, distance and speed.

SUMMARY OF THE PRESENT INVENTION

Aim at the defects in the prior art, the object of the present utility model is to provide a fitness display device and a fitness weight device.

According to the fitness display device provided by the present utility model, it comprises an outer casing arranged on a guiding rail and can move under the limit of the guiding rail, the outer casing is provided with a display screen, and a generator, a PCB, a tension sensor and a rechargeable battery are provided in the outer casing, wherein:

The PCB is provided with a charging circuit and a control chip;

The generator is connected with a rechargeable battery through the charging circuit;

A rotor of the generator is contacted with the guiding rail, wherein when the outer casing moves, the rotor of the generator is driven to rotate by the guiding rail;

The rechargeable battery is electrically connected with the PCB;

The tension sensor and the display screen are electrically connected with the PCB respectively;

The tension sensor is arranged between an outer equipment and a hanging rod.

Preferably, the PCB further is provided with a wireless unit arranged thereon and electrically connected with the control chip.

Preferably, the PCB further includes a USB interface.

Preferably, the guiding rail is a pillar guiding rail.

Preferably, a concave surface is provided on a side of the guiding rail, and the rotor of the generator is contacted with the concave surface.

Preferably, the guiding rail is a pillar guiding rail, a side of the rotor has a concave surface, wherein the shape of the concave surface is matched with the shape of the pillar guiding rail, and the concave surface of the side of the rotor is in line contact with the side surface of the guiding rail.

Preferably, in the axial direction of the rotor, a part of the rotor section that is not in contact with the guiding rail is located between the guiding rail and the motor of the generator, so that the motor and the guiding rail define a gap therebetween.

Preferably, the outer casing comprises a casing body and a cover plate;

The cover plate covers the opening of the casing body on an edge of the opening from above;

The cover plate is provided with a through hole allowing the guiding rail to penetrate through;

After the cover plate is removed, the rotor of the generator is exposed and visible.

Preferably, the surface of the rotor, which is in contact with the guiding rail, is provided with an elastic layer.

The present utility model provides a fitness weight device, which comprises a base, a guiding rail, a hanging rod, a plurality of metal blocks and the fitness display device, wherein:

The guiding rail is arranged on the base;

The metal blocks are stacked on the base under the limit of the guiding rail;

Each of the metal blocks has a vertical through hole provided in the vertical direction and a first horizontal through hole provided in the horizontal direction, which penetrates through the shaft of the vertical through hole, wherein the vertical through holes of the metal blocks are coaxially arranged in a vertical position;

The hanging rod is extended into the vertical through hole of the metal block from top to bottom, wherein a plurality of second horizontal through holes which are matched with the first horizontal through hole are arranged in the hanging rod, wherein the hanging rod is inserted into the first horizontal through hole and the second horizontal through holes through a connecting member to be locked with the metal blocks;

The fitness display device is arranged above the metal blocks.

Preferably, the shape of the outer casing is the same as that of the metal block.

Preferably, the first horizontal through holes of the metal blocks are in the same vertical plane.

Preferably, the distance between every two neighboring second horizontal through holes of the hanging rod and the distance between every two neighboring first horizontal through holes are the same.

Preferably, the top end of the hanging rod is provided with a hanger, and the outer equipment is connected with the hanging rod through the connection between a cable and the hanger.

Compared with the prior art, the present utility model has the following beneficial effects:

1. The present utility model has a reasonable structure, and is ingeniously designed, intuitive and convenient;
2. By setting the generator, on the one hand, the rotation of the rotor of the generator of the present utility model acts as a speed sensor, and on the other hand, the present utility model can realize the power generation function through the rolling of the generator rotor.

According to the further optimization of the present utility model, it is helpful to realize:

1. By setting the display unit, the movement data such as training weight, times and range can be displayed intuitively;
2. The obtained data will be sent to a mobile device or Cloud through a wireless module, and combined with an appropriate APP and other software, the exercise process is accurately described to lay the foundation for digitizing the training process and training effect.

BRIEF DESCRIPTION OF THE DRAWINGS

By reading the detailed description of the non-limiting embodiments with reference to the following drawings, other features, purposes and advantages of the present utility model will become more obvious.

Figure 1:
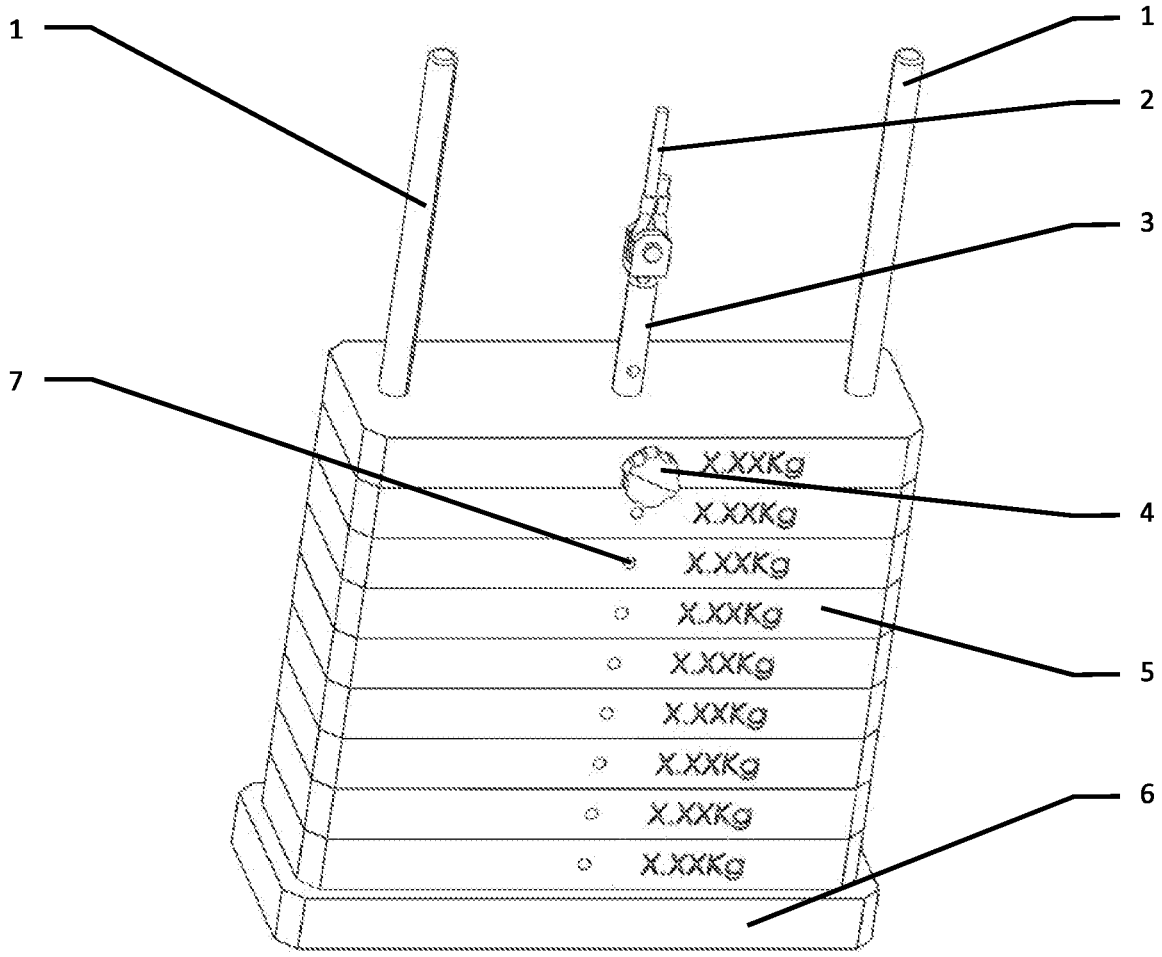
FIG. 1 is a structure diagram of the existing weight device.
Figure 2:
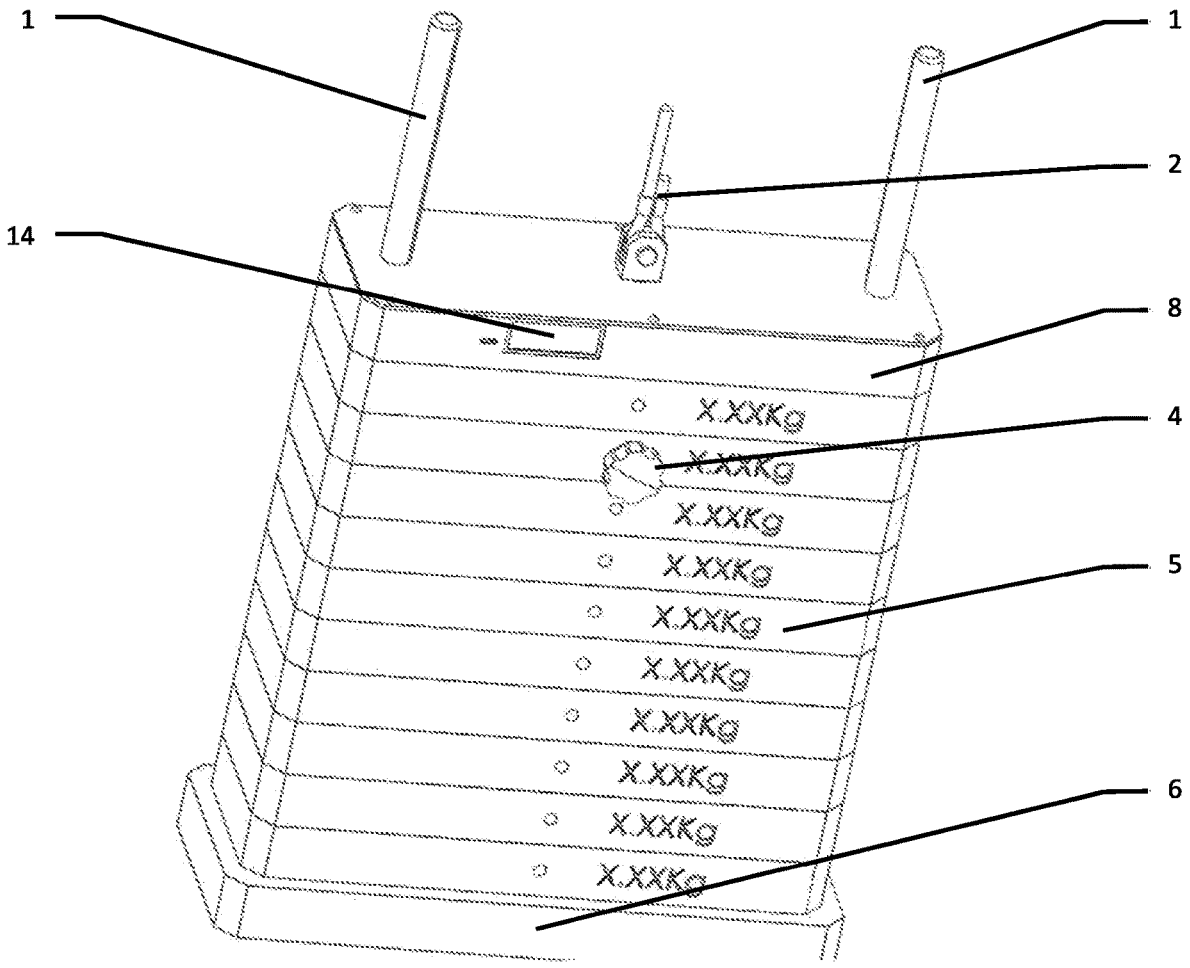
FIG. 2 is a structural diagram of a visual angle of the fitness weight device provided by the present utility model.

In the above Figs, the figure number 1 represents the guiding rail, the figure number 2 represents the connecting cable, the figure number 3 represents the hanging rod, the figure number 4 represents a pin, the figure number 5 represents the metal block, the figure number 6 represents the base, the figure number 7 represents a through hole, the figure number 8 represents an intelligent module, the figure number 9 represents the tension sensor, the figure number 10 represents the rechargeable battery, the figure number 11 represents the generator, the figure number 12 represents the PCB, the figure number 13 represents a USB interface, the figure number 13 represents the display screen.

DETAILED DESCRIPTION OF THE PREFERRED EMBODIMENT

The present utility model is described in detail in combination with specific embodiments as below. The following embodiments will help those skilled in the art to further understand the present utility model, but will not limit the present utility model in any form. It should be noted that for those skilled in the art, certain changes and improvements can be made without departing from the concept of the present utility model. These belong to the protection scope of the present utility model.

As shown in FIG. 1, the structure of an existing weight block is illustrated, which comprises several metal blocks 5 having "X.XXKg" marked thereon and specific weight. Each of the metal blocks 5 has a through hole 7 provided in the front of the metal block 5, and a pin 4 can be inserted into the through hole 7 of a selected metal block 5 and through the corresponding through hole of the hanging rod 3, so that the selected weight can be hung on the hanging rod 3. When an outer equipment pulls the connecting cable 2, the hanging rod 3 and the metal block 5 that is hung on the hanging rod 3 by the pin 4 will be pulled up at the same time, the selected metal blocks 5 above the pin 4 will move up and down along the guiding rail 1 as an upwards outer force is added and removed. The unselected metal blocks 5 below the pin 4 will still be set on the base 6 and will not move up and down along the hanging rod 3. However, the structure of the existing weight device has the following problems: the structure of the existing weight block system does not have the ability to sense the precise weight, speed, moving distance and other parameters, does not generate data when moving, and does not have the function to output data and further mine. It does not record the whole sports data scientifically after athletes finish each exercise.

As shown in FIGS. 2 to 11, the present utility model further comprises an intelligent module 8 on the basis of the original structure of the existing weight device, and the intelligent module 8 is arranged on the top of all the weight blocks 5, such that whether the pin 4 is selected in the first weight block 5 or the last weight block 5, the intelligent module 8 can be operated accordingly, accurately perceive the weight, amplitude and speed generated by each outer force through the connecting cable 2, and display corresponding data on the display screen 14, at the same time, the above data will be sent to mobile devices such as mobile phones, tablets, etc., as well as to the Cloud for use by relevant APPs and software. The intelligent module 8 includes an outer casing 81, a display screen 14 arranged on the outer casing 81, a generator 11, a PCB 12, a tension sensor 9, a wireless unit 82, and a rechargeable battery 10, which are provided within the outer casing 81. The shape of the outer casing 81 is preferably the same as that of the metal block 5.

Figure 11:
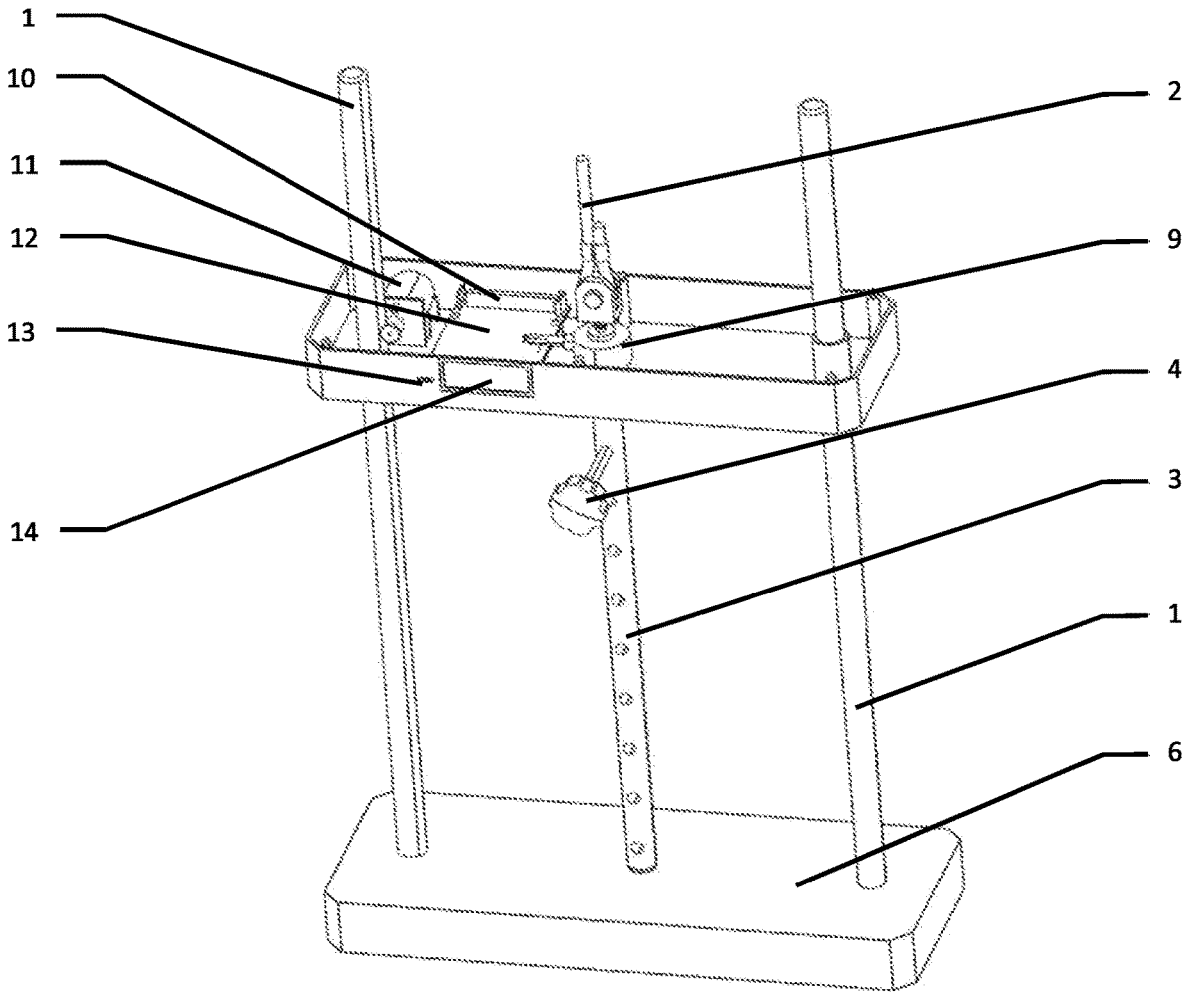
FIG. 11 is a structural diagram of a display device of the fitness weight device provided by the present utility model.

As shown in FIG. 11, the tension sensor 9 is installed between the connecting cable 2 and the hanging rod 3, wherein when the connecting cable 2 pulls up the metal block 5 hung on the hanging rod 3, the weight pulled is sensed in real time through the tension sensor 9, wherein a data line of the tension sensor 9 is electrically connected to the PCB 12, wherein the generator 11 is installed inside the intelligent module 8, the rotor 111 of the generator 11 is contacted with the guiding rail 1, wherein each time, the hanging rod 3 is pull by the outer force through the connecting cable 2 to move up and down, the rotor 111 of the generator 11 will roll along the guiding rail 1, wherein whether the hanging rod 3 is pulled up or down, the rotor 111 of the generator 11 will roll along the guiding rail 1 to start generating electricity, wherein a related circuit is designed on the PCB 12 to charge the rechargeable battery 10 with electricity from the generator 11; at the same time, since the output voltage of the generator 11 is a function of the rolling speed of the rotor 111 of the generator 11 on the guiding rail 1, the generator 11 can actually be used as a speed sensor to charge the rechargeable battery 10 and send the rolling speed data to the PCB 12 for use on the PCB 12. It should be pointed out that it is possible for those skilled in the art to set relevant circuits on the PCB 12 based on the prior art, and this patent will not described again.

Furthermore, the present utility model can be provided with a sensor for directly reading the moving distance of the weight blocks 5, or a sensor for reading the number of turns of the rotor 111 of the generator 11, and multiply it by the circumference of the rotor 111 of the generator 11 to obtain the moving distance of moving up and down along the guiding rail 1. Then, the users motion amplitude is calculated indirectly according to the mechanical structure of the application device, and is displayed on the display unit 14.

The electricity generating way of the rotor 111 of the generator 11 sticking to the guiding rail 1 is generally that the friction between the guiding rail 1 and the rotor 111 of the generator 11 drives the rotor 111 of the generator 11 to rotate and generate electricity. In order to protect the rotor 111 of the generator 11, a gear can be fastened on the rotor 111 of the generator 11, and a rack can be fastened on the guiding rail 1, and the electricity is generated by a meshing movement between the rack and the gear driving the rotor 111 of the generator 11 to rotate.

Figure 3:
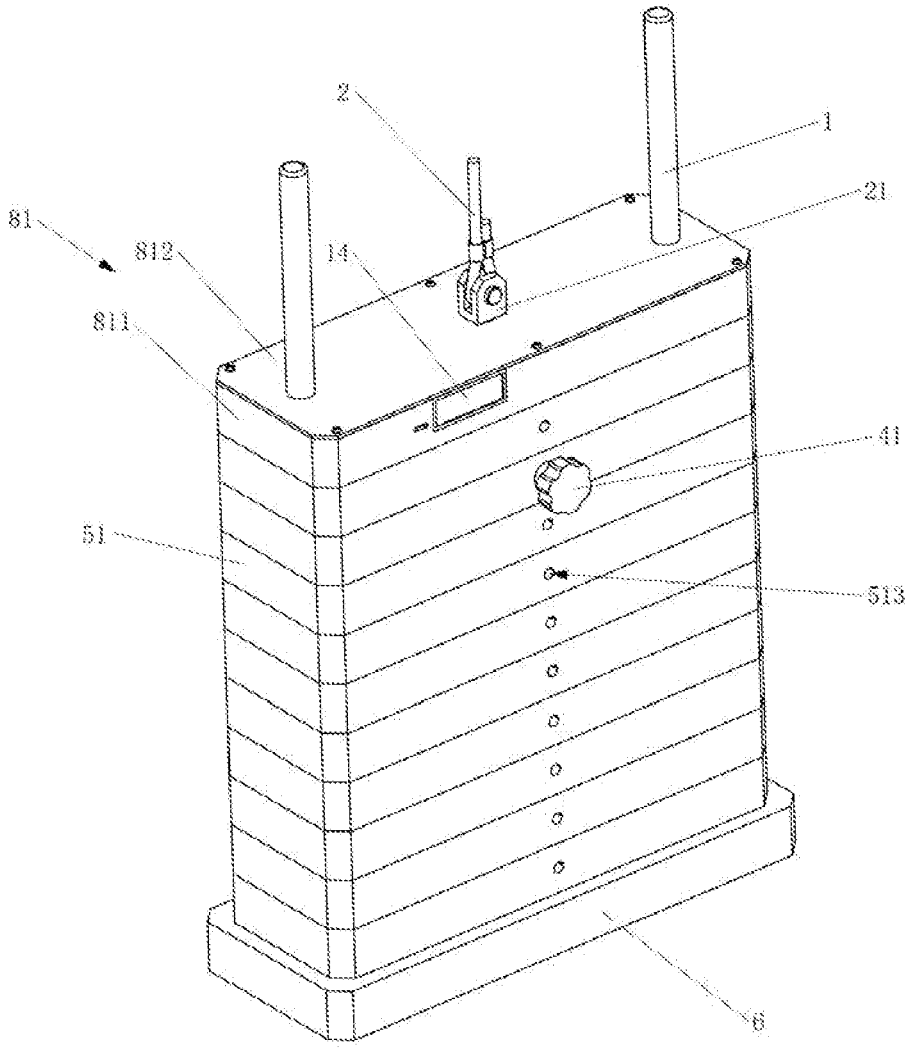
FIG. 3 is a structural diagram of another visual angle of the fitness weight device provided by the present utility model.
Figure 4:
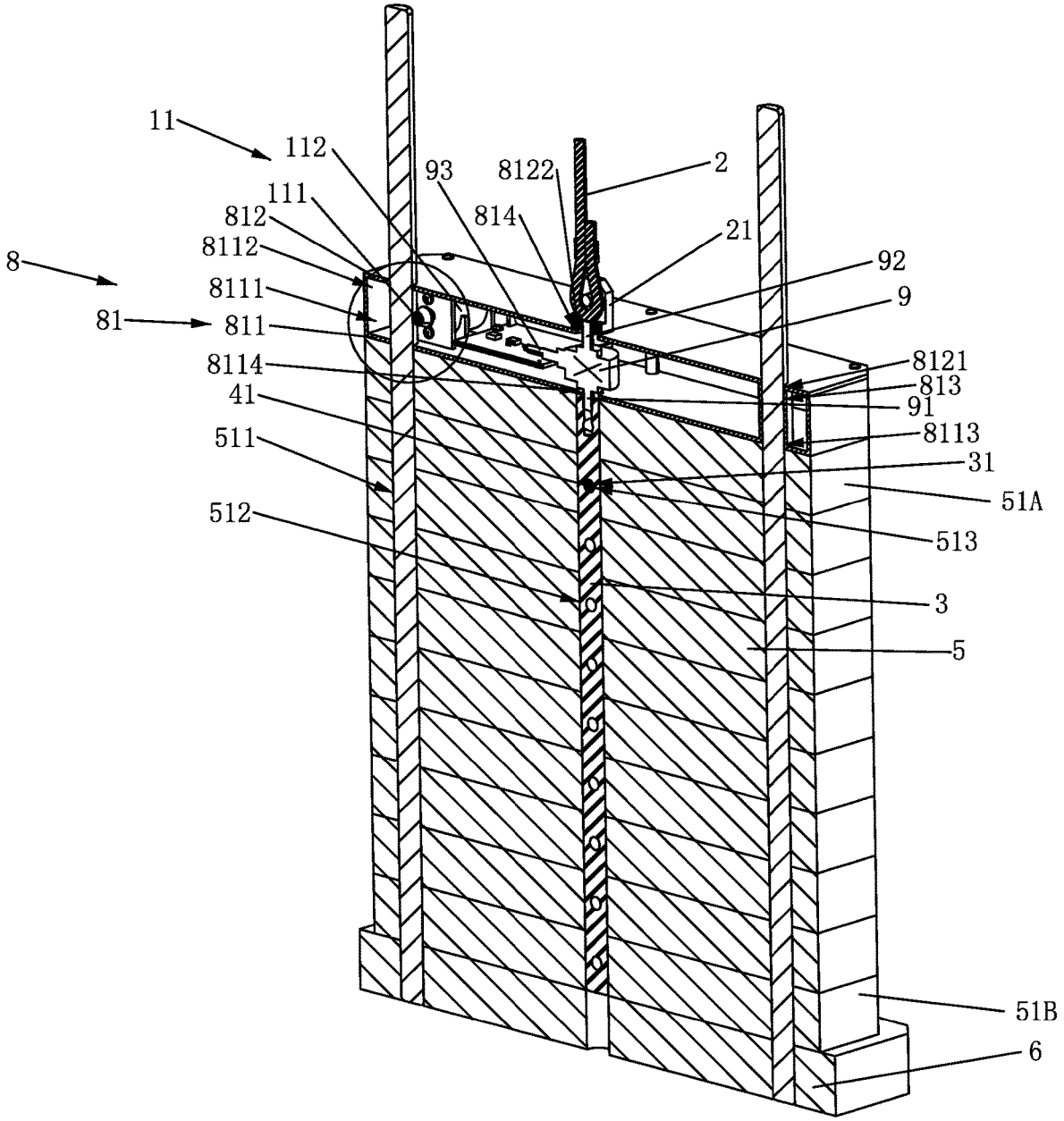
FIG. 4 is a sectional diagram of the fitness weight device provided by the present utility model.
Figure 5:
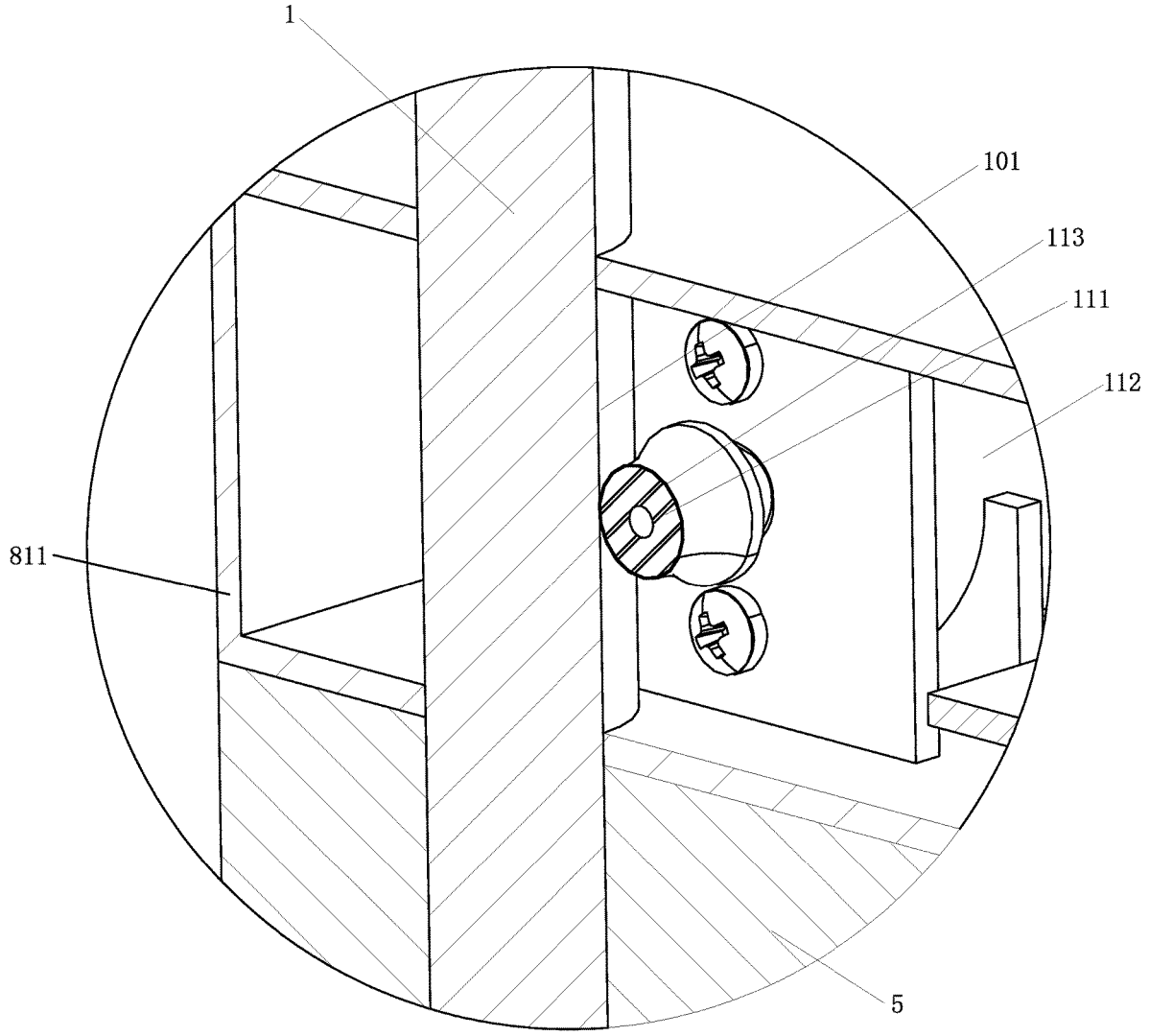
FIG. 5 is an enlarged schematic diagram of a local position of the fitness weight device shown in FIG. 4.
Figure 6:
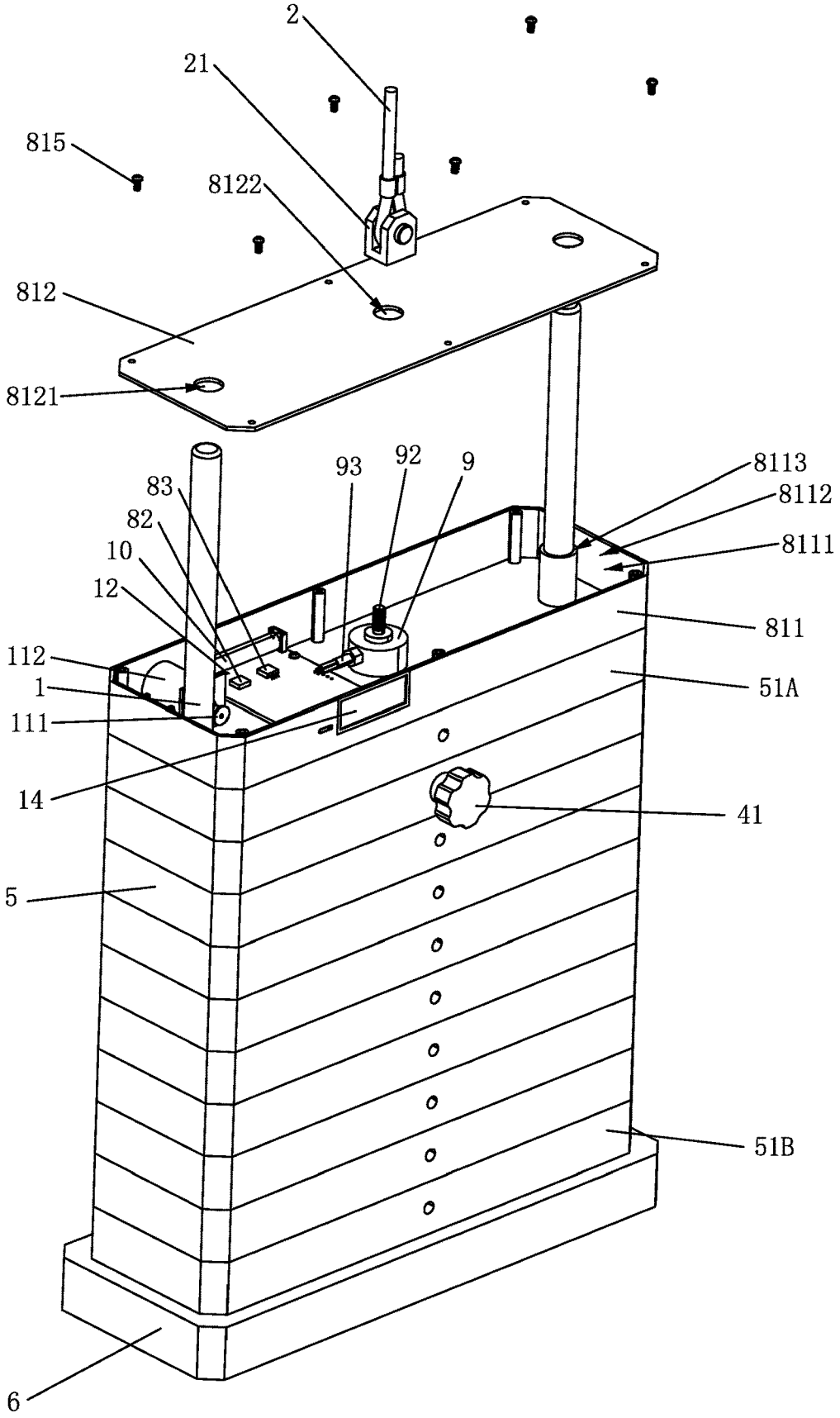
FIG. 6 is an exploded diagram of a visual angle of the fitness weight device provided by the present utility model.
Figure 7:
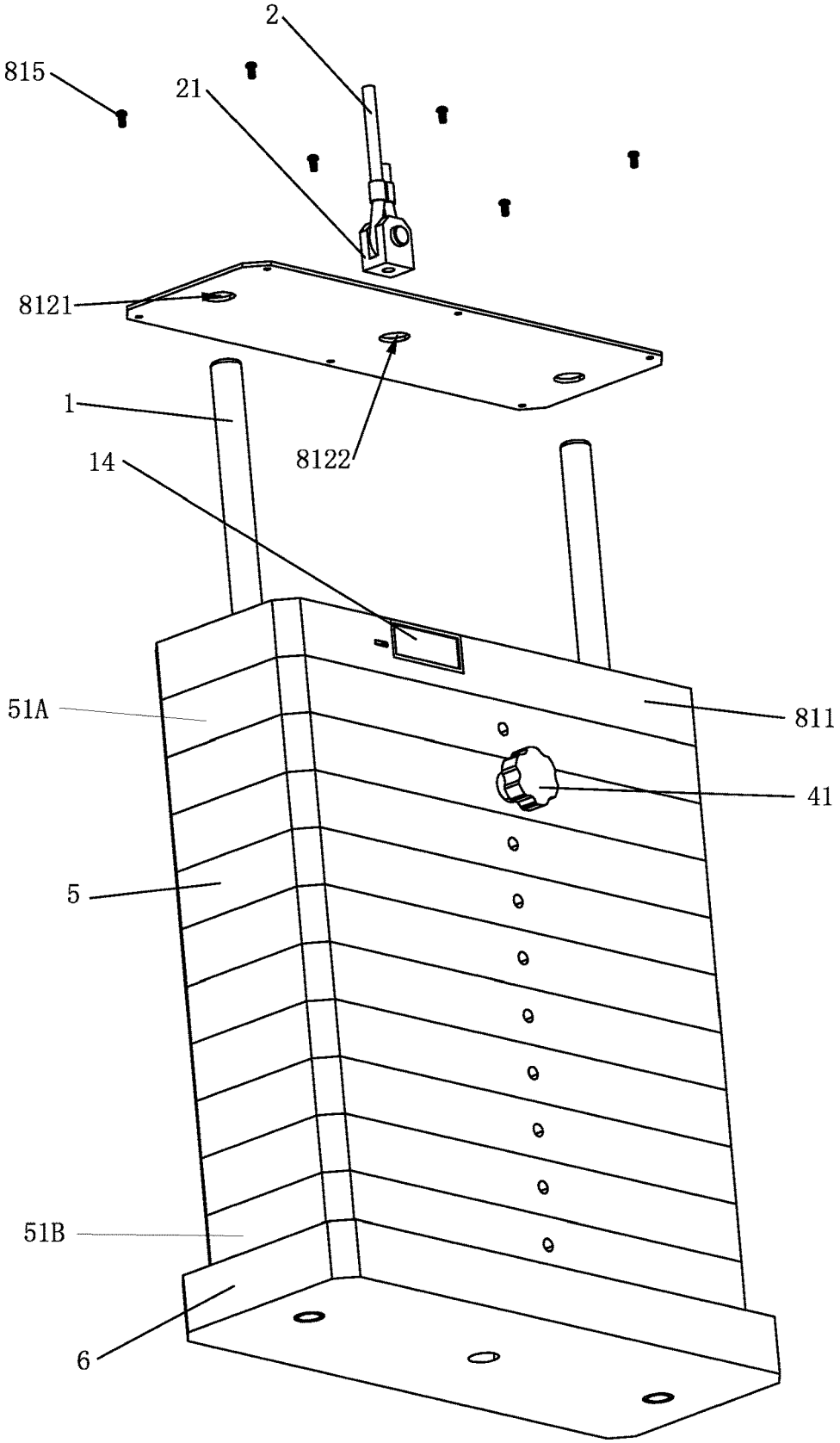
FIG. 7 is an exploded diagram of another visual angle of the fitness weight device provided by the present utility model.
Figure 8:
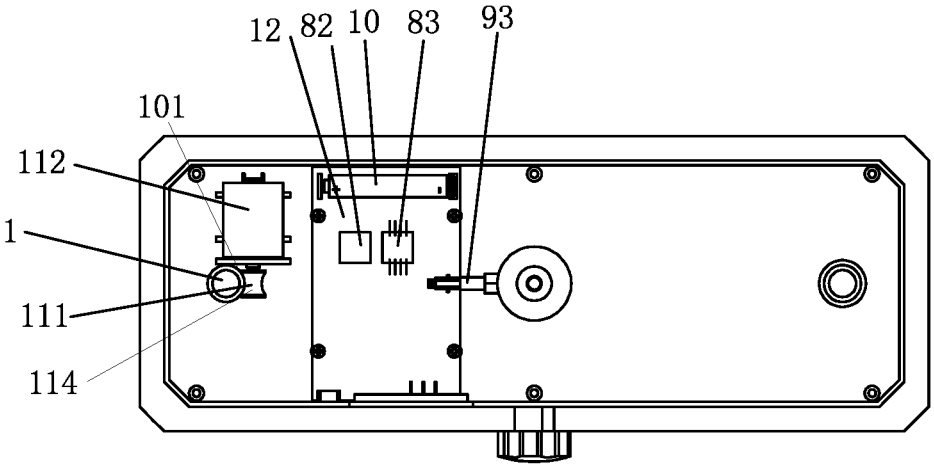
FIG. 8 is a top view diagram of a local position of the fitness weight device provided by the present utility model.
Figure 9:
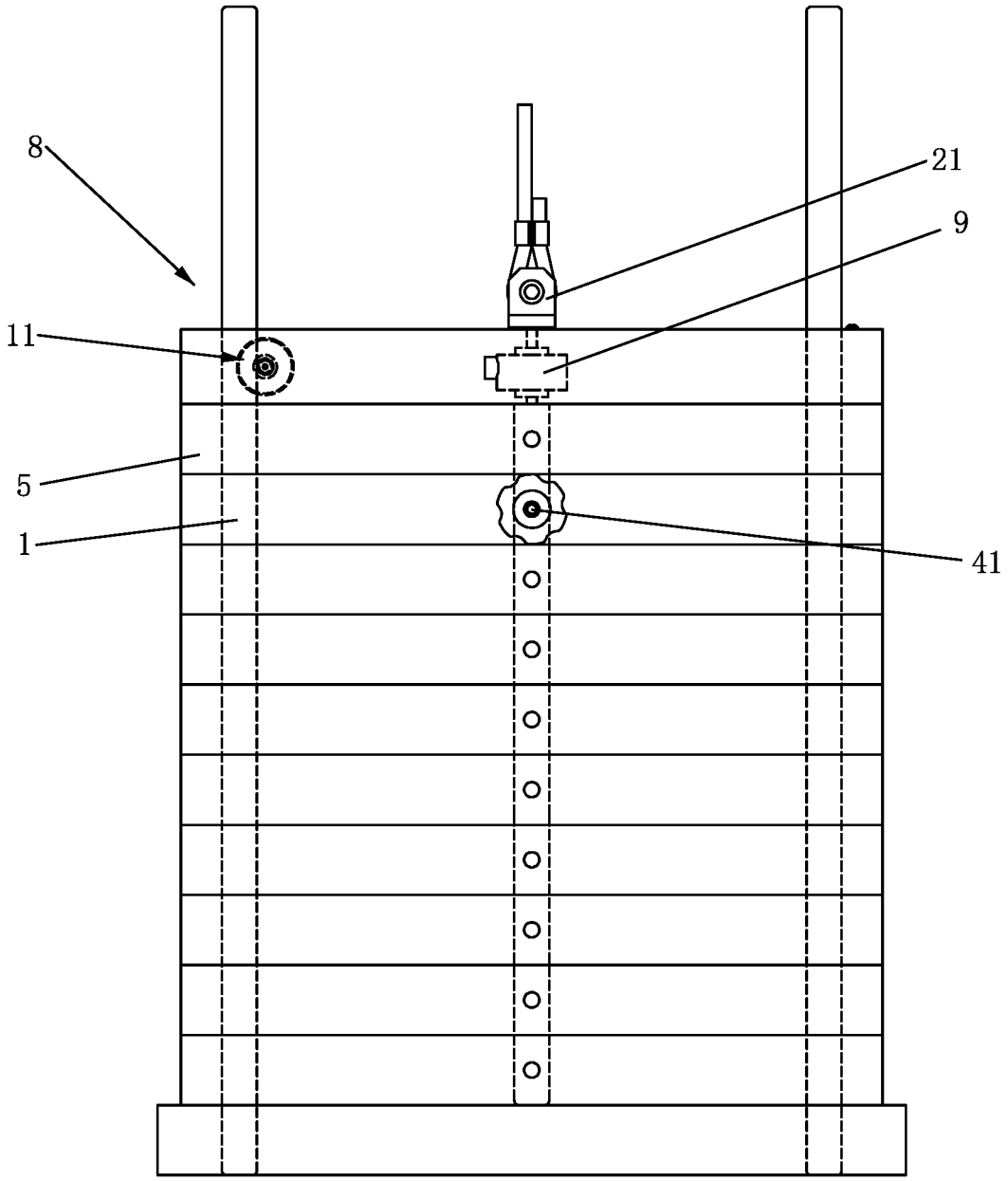
FIG. 9 is a front view diagram of the fitness weight device provided by the present utility model, which is under a use state.
Figure 10:
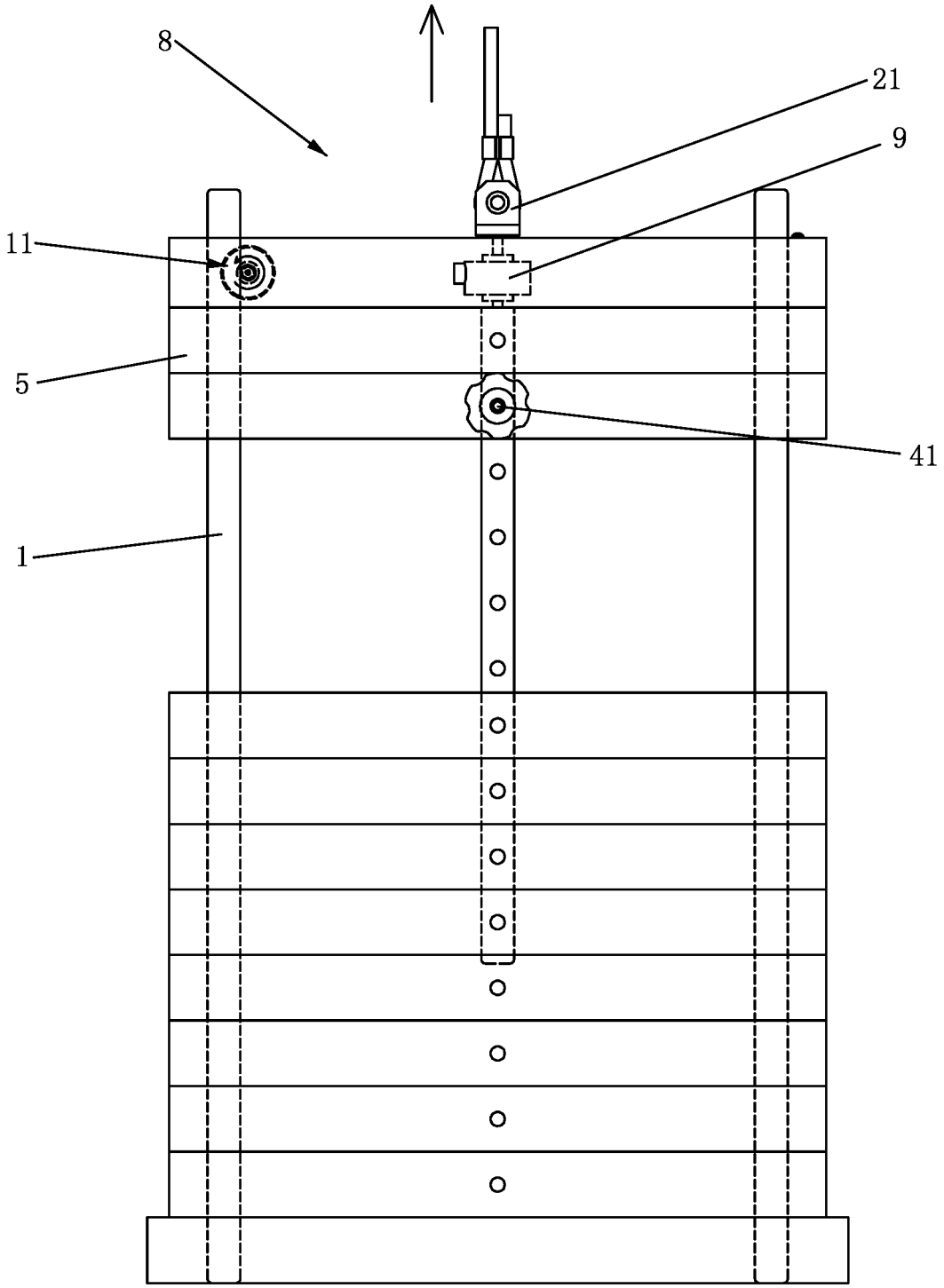
FIG. 10 is a front view diagram of the fitness weight device provided by the present utility model, which is under another use state.

Alternatively, As shown in FIG. 3, a side of the guiding rail 1 defines a concave surface, and considering that the guiding rail 1 is a pillar guiding rail and the rotor 111 of the generator 11 is a circular rotor, the rotor 111 of the generator 11 can be contacted with the guiding rail 1 by the concave surface properly. The material of the guiding rail 1 can be light and hard, such as aluminum alloy. The outer casing 81 includes a casing body 811 and a cover plate 812, wherein the cover plate 812 covers an opening 8111 of the casing body 811 on an edge of the opening 8111 from above, wherein the cover plate 812 is provided with a through hole 8121 to allow the guiding rail 1 to penetrate through, and when after the cover plate 812 is removed, the rotor 111 of the generator 11 is exposed and visible. After the cover plate 812 is removed, the generator 11 can be directly installed and adjusted.

Preferably, the guiding rail 1 is a cylindrical guiding rail, a side surface 114 of the rotor 111 of the generator 11 is a concave surface, the shape of the concave surface is matched with the shape of the cylindrical guiding rail 1, such that the concave surface is in line contact with the side of the guiding rail 1. In the axial direction of the rotor 111 of the generator 11, a part of the rotor 111 of the generator 11 that is not in contact with the guiding rail 1 is located between the guiding rail 1 and the motor of the generator 11, so that there is a gap between the generator 11 and the guiding rail 1.

Furthermore, if both the guiding rail 1 and the rotor 111 of the generator 11 are rigid, then the contact type between them is a line contact. If either of them is provided with an elastic layer on a contact surface of either of them, or either of them is an elastic body itself, since the elastic layer or the elastic body deforms when they are contacted with each other, then the contact type between the guiding rail 1 and the rotor 111 of the generator 11 is a surface contact.

The contact surface of the rotor 111 of the generator 11, which is contacted with the guiding rail 1, has an elastic layer to obtain a larger contact area, help protect the rotor 111 and prolong the service life of the rotor 111.

As shown in FIG. 3, the intelligent module 8 is equipped with a display screen 14 and a USB interface 13, which are both connected to the PCB 12, wherein the display screen 14 can display information set by a central control unit 83 provided on the PCB 12, such as weight, speed, calories and other data. The display screen 14 is arranged at the same side as the pin 4, so that the user can directly view the data. The USB interface 13 has three functions: one function is enable the rechargeable battery 10 to be recharged through the USB interface 13 by an outer charging bank or mobile device charger, such as a mobile phone charger. This rarely happens. Usually, the rechargeable battery 10 loses power after the device is not used for a long time. The second function is to charge mobile devices such as mobile phones and Pads through the USB interface 13 with the electricity generated from the generator 11. The third function is for maintenance and debugging. It should be pointed out that the circuit design of the PCB 12 of the present utility model can be realized by those skilled in the art according to the existing technology. The PCB 12 mainly controls the data of the display screen 14 and the tension sensor 9, and its circuit design belongs to the existing technology, and will not be described again here.

Furthermore, the PCB 12 is also designed with a wireless unit 82, which can be a WIFI, Bluetooth, NBiot or other communication modules such as 2G, 3G, 4G, 5G, etc., and can send data such as weight and speed data to mobile devices such as mobile phones, tablets, etc., or to the Cloud for being used by other APPs or software.

Referring to FIGS. 2 to 11, the fitness weight device of the present utility model comprises at least one guiding rail 1, a pulling member 21, a hanging rod 3, a connecting member 41, a plurality of weight plates 51, a base 6 and an intelligent module 8.

The guiding rail 1 has a bottom end connected with the base 6, so that the guiding rail 1 and the base 6 can be connected as a whole. Preferably, two guiding rails 1 are symmetrically arranged at two opposite ends of the base 6.

In a specific example of the fitness weight device of the present utility model, which is shown in FIGS. 2 to 11, the metal blocks 5 can be used as a specific example of the weight plate 51, wherein the weight plate 51 has a guiding rail through hole 511, which is extended along the height direction of the weight plate 51 for allowing the guiding rail 1 to penetrate through, so that the guiding rail 1 can limit the movement direction of the weight plate 51. Preferably, the weight plate 51 has two guiding rail through holes 511, which are symmetrically arranged at two opposite ends of the weight plate 5. In this way, each guiding rail 1 limits the movement direction of the weight plate 51 at each end of the weight plate 51 to avoid rotation or inclination of the weight plate 51 when it moves up and down.

Each of the weight plates 51 has a vertical through hole 512 and a first horizontal through hole 513 communicated with the vertical through hole 512, wherein the vertical through hole 512 is extended along the height direction of the weight plate 51, and the first horizontal through hole 513 is extended along the width direction of the weight plate 51. The hanging rod 3 has a top end connected with the pulling member 21, and the hanging rod 3 has a plurality of second horizontal through holes 31, wherein the hanging rod 3 is inserted into the vertical through holes 512 of the weight plates 51 from top to bottom, and the second horizontal through holes 31 of the hanging rod 3 can correspond to and be communicated with the first horizontal through holes 513 of the weight plates 51 respectively, and the pin 4 implemented as the connecting member 41 can be inserted into the first horizontal through hole 513 of the weight plate 51 and the second horizontal through hole 31 of the hanging rod 3, such that the hanging rod 3 and a selected weight plate 51 of the weight plates 51 are locked together by the connecting member 41, in this way, the user can pull the selected weight plate 51 (or the selected weight plates 51) to move upwards through the cable 2 tied to the pulling member 21 and the hanging rod 3, so as to achieve a fitness purpose. It is understood by those skilled in the art that the selected weight plate 51 and the selected weight plates 51 (if any) stacked above the selected weight plate 51 can be lifted and put down, after the connecting member 41 is inserted into the first horizontal through hole 513 of the selected weight plate 51 and the corresponding second horizontal through hole 31 of the hanging rod 3.

The intelligent module 8 includes an outer casing 81 and a generator 11. The outer casing 81 includes a casing body 811 and a cover plate 812, wherein the casing body 811 has a casing space 8111 and an opening 8112 communicated with the casing space 8111, wherein the cover plate 812 covers the opening 8112 of the casing body 811 on an edge of the opening 811 from top to close the casing space 8111 of the casing body 811, wherein the motor body 112 of the generator 11 is fixedly installed on the casing body 811, and the rotor 111 of the generator 11 is allowed to rotate within the casing space 811 of the casing body 811. The fixing methods of the casing body 811 and the cover plate 812 are not limited, for example, they can be locked by a screw 815.

The casing body 811 has an edge casing hole 8113 and a middle casing hole 8114 respectively communicated with the casing space 8111, the cover plate 812 has an edge cover hole 8121 and a middle cover hole 8122, wherein the edge cover hole 8121 of the cover plate 812 corresponds to the edge casing hole 8113 of the casing body 811 to form an edge through hole 813 of the outer casing 81, the middle cover hole 8122 of the cover plate 812 corresponds to the middle casing hole 8114 of the casing body 811 to form a middle through hole 814 of the outer casing 81. The outer casing 81 is stacked on the weight plate 51, and the edge through hole 813 of the outer casing 81 is communicated with the guiding rail through hole 511 of the weight plate 51 to allow the guiding rail 1 to penetrate through the edge through hole 813 of the outer casing 81, and the middle through hole 814 of the outer casing 81 is communicated with the vertical through hole 512 of the weight plate 51 to allow the hanging rod 3 to penetrate through the middle through hole 814 of the outer casing 81. The rotor 111 of the generator 11 is contacted with the guiding rail 1, wherein when the user pulls the weight plate 51 and the intelligent module 8 up through the cable 2 and the hanging rod 3 attached to the pulling member 21 and when the weight plate 51 and the intelligent module 8 move downward based on their own gravity, the rotor 111 of the generator 11 is rotated by the guiding rail 1, so that the generator 11 can generate electricity.

Preferably, the intelligent module 8 includes a PCB 12 and a central control unit 83 (for example, MCU) attached on the PCB 12, wherein the PCB 12 is provided within the casing space 8111 of the casing 811, and the motor body 112 of the generator 11 is connected with the PCB 12. The intelligent module 8 further comprises a tension sensor 9, which is arranged in the casing space 8111 of the casing 811, wherein the tension sensor 9 has a first connecting end 91, a second connecting end 92 opposite to the first connecting end 91, and a data output end 93, wherein the first connecting end 91 of the tension sensor 9 is connected with the top of the hanging rod 3, the second connecting end 92 of the tension sensor 9 is connected with the pulling member 21, wherein the hanging rod 3 and the pulling member 21 are connected by the tension sensor 9, the data output end 93 of the tension sensor 9 is connected with the PCB 12. The central control unit 83 can control the generator 11 to supply power to the tension sensor 9 through the PCB 12 and obtain data from the tension sensor 9 through the PCB 12.

Preferably, the intelligent module 8 includes a rechargeable battery 10, which is arranged within the casing space 8111 of the casing 811 and connected with the PCB 12, wherein the central control unit 83 can control the generator 11 to supply power to the rechargeable battery 10 through the PCB 12. In addition, the rechargeable battery 10 can be controlled by the central control unit 83 to supply power to the tension sensor 9 through the PCB 12.

Preferably, the intelligent module 8 includes a display screen 14, which is electrically connected with the PCB 12 to visually display corresponding data for the user to view. For example, the data obtained from the tension sensor 9 can be displayed on the display screen 14. Preferably, the display screen 14 is arranged on the casing body 811.

Preferably, the intelligent module 8 includes a wireless unit 82, which is attached on the PCB 12 and electrically connected with the central control unit 83, wherein the central control unit 83 can control the wireless unit 82 to connect with a peripheral equipment.

Accordingly, as shown in FIGS. 2 to 11, a weight assembly for fitness is provided by the present utility model comprises a pulling member 21, a connecting member 41, at least one guiding rail 1 fixed vertically at a proper position, a plurality of weight plates 51 stacked vertically to define a weight stack having a first weight plate 51A and a last weight plate 51B, wherein each of the weight plates 51 has a first horizontal through hole 513 and a vertical through hole 512 communicated with the first horizontal through hole 513, a hanging rod 3 having a plurality of second horizontal through holes 31 and coupled with the pulling member 21, wherein when the hanging rod 3 is inserted into the vertical through holes 512 of the weight plates 51, the first horizontal through holes 513 of the weight plates 51 are communicated with the second horizontal through holes 31 of the hanging rod 3 respectively to define a plurality of connecting through holes 510, so as to enable the connecting member 41 to be selectively inserted into a selected connecting through hole 510 and make a selected weight plate 51 be hung at the hanging rod 3, wherein each of the weight plates 51 is able to move relative to the guiding rail 1 freely and reciprocatingly in a vertical direction and a generator 11 having a rotor 111 and coupled with the first weight plate 51A, wherein the rotor 111 of the generator 11 is contacted with the guiding rail 1 such that when the generator 11 is driven to move relative to the guiding rail 1, the rotor 111 of the generator 11 is capable of rolling to make the generator 11 generate electricity.

Further, the weight assembly for fitness is provided by the present utility model comprises a central control unit 83 electrically connected with the generator 11, wherein the central control unit 83 is configured to obtain the rolling speed of the rotor 111 of the generator 11 base on the output voltage of the generator 11.

Further, the weight assembly for fitness is provided by the present utility model comprises a rechargeable battery 10 electrically connected with the generator 11, wherein the generator 11 is configured to charge the rechargeable battery 10.

Further, the weight assembly for fitness is provided by the present utility model comprises a tension sensor 9 having a first connecting end 91 fixed to the pulling member 21 and a second connecting end 92 fixed to the hanging rod 3 such that the weight of the weight plates 51 lifted through the hanging rod 3 is applied on the tension sensor 9 through the hanging rod 3 and the pulling member 21 to activate the tension sensor 9 to generate a weight data. Further, the central control unit 83 is electrically connected with the tension sensor 9, wherein the central control unit 83 is configured to receive the weight data from the tension sensor 9. Preferably, the tension sensor 9 is electrically connected with the rechargeable battery 10 to be supplied power.

Further, the guiding rail 1 of the weight assembly for fitness is provided by the present utility model has a convex surface 101, the rotor 111 of the generator 11 has a concave surface 114, wherein the concave surface 114 of the rotor 111 of the generator 11 is matched with the convex surface 101 of the guiding rail 1, and the guiding rail 1 and the rotor 111 of the generator 11 are rigid such that the convex surface 101 of the guiding rail 1 and the concave surface 114 of the rotor 111 of the generator 11 define a line contact therebetween. Alternatively, the guiding rail 1 of the weight assembly for fitness is provided by the present utility model has a concave surface 114, the rotor 111 of the generator 11 has a convex surface 101, wherein the concave surface 114 of the guiding rail 1 is matched with the convex surface 101 of the rotor 111 of the generator 11, and the guiding rail 1 and the rotor 111 of the generator 11 are rigid such that the concave surface 114 of the guiding rail 1 and the convex surface 101 of the rotor 111 of the generator 11 define a line contact therebetween.

The specific embodiments of the present utility model are described above. It should be understood that the present utility model is not limited to the above specific embodiments, and those skilled in the art can make various changes or modifications within the scope of the claims, which does not affect the substantive content of The present utility model. Without conflict, the embodiments and features in the embodiments of the present application can be combined with each other at will.

What is claimed is:

1. A weight assembly for fitness, comprising:

a pulling member;

a connecting member;

a bearing rod having a plurality of first horizontal through holes;

a plurality of weight plates stacked vertically to define a weight stack having a first weight plate and a last weight plate, wherein each of the weight plates has a second horizontal through hole, wherein the second horizontal through holes of the weight plates are communicated with the first horizontal through holes of the bearing rod to define a plurality of connecting through holes, so as to enable the connecting member to be selectively inserted into a selected connecting through hole and make a selected weight plate be hung at the bearing rod; and a tension sensor having a first connecting end fixed to the pulling member and a second connecting end fixed to the bearing rod.

2. The weight assembly for fitness, as recited in claim 1, further comprising a central control unit electrically connected with the tension sensor, wherein the central control unit is configured to receive a weight data from the tension sensor.

* * * * *